US005784844A

United States Patent [19]

Mackarvich

[11] Patent Number: 5,784,844

[45] Date of Patent: Jul. 28, 1998

[54] FOUNDATION FOR MANUFACTURED HOME

[76] Inventor: Charles J. Mackarvich, 1720 Tyler Green Trail, Smyrna, Ga. 30080

[21] Appl. No.: 644,069

[22] Filed: May 9, 1996

Related U.S. Application Data

[63] Continuation-in-part of Ser. No. 629,834, Apr. 10, 1996.

[51] Int. Cl.[6] ..... E02D 27/00

[52] U.S. Cl. ..... 52/292; 52/DIG. 11; 52/299; 52/146

[58] Field of Search ..... 52/169.9, DIG. 11, 52/23, 148, 146, 299, 155, 156, 157

[56] References Cited

U.S. PATENT DOCUMENTS

| | | | |
|---|---|---|---|
| 3,747,288 | 7/1973 | Grimelii | 52/23 |
| 3,750,349 | 8/1973 | Deike | 52/292 X |
| 3,751,866 | 8/1973 | Renchen | 52/149 |
| 3,830,024 | 8/1974 | Warnke | 52/23 |
| 3,845,597 | 11/1974 | Foster | 52/166 |
| 4,261,149 | 4/1981 | Gustafson | 52/292 X |

OTHER PUBLICATIONS

"Laboratory Testing of Soil Anchors for U.S. Department of Housing and Urban Development Washington, DC" from HUD User's Document Reproduction Service, 47 pages.

"Nistir 5664 Recommended Performance–Based Criteria for the Design of Manufactured Home Foundation Systems to Resist Wind and Seismic Loads", Aug. 1995, 69 pages.

"Manufactured Housing Anchoring Installation Information Provided by Tie Down Engineering", pamphlet, 5 pages.

"Ironroot Earth Anchors", by Tie Down Engineering, pamphlet, 3 pages.

"Manufactured Housing Institute Memorandum from Frank Walter, Jan. 10, 1995, NIST Study on Manufactured Home Anchoring Systems", 55 pages.

*Primary Examiner*—Creighton Smith

*Attorney, Agent, or Firm*—Thomas, Kayden, Horstemeyer & Risley

[57] ABSTRACT

Stabilizer bars (28) and (30) extend across the lengths of the I-beam joists (12) and (14), beneath the piers (16) and (18). Tie down anchors (32) and (34) are placed in abutment with the outer ends of the stabilizer bars, so that the anchors cannot be pulled and bent toward the manufactured home due to the forces in the anchor ties (101) and (110). Tie down shoes (50) and (51) are mounted at the lower portions of the piers (16) and (18), and ties (101, 102, 104, 106, 108, 110) are connected to the tie down shoes so as to increase the resistance of the manufactured home (11) from shifting laterally and from lifting off the foundation.

14 Claims, 6 Drawing Sheets

FOUNDATION FOR MANUFACTURED HOME

CROSS REFERENCE

This is a continuation-in-part of U.S. patent application Ser. No. 08/629,834, filed Apr. 10, 1996.

FIELD OF THE INVENTION

This invention relates to a foundation for a manufactured home which rests above the ground on piers. Anchors which penetrate the ground are connected by ties to the lower portion of the frame of the manufactured home, holding the home on the piers.

BACKGROUND OF THE INVENTION

Manufactured homes, such as mobile homes, trailers, prefabricated houses, and the like are manufactured at a central manufacturing site, and upon completion the homes are moved to a location where they are to be permanently located and occupied. Because these homes are designed to be easily moved from the manufacturing site to the permanent location, they are not originally built on a permanent foundation at the manufacturing site, but on a pair of parallel I-beam joists, and then the manufactured home is transported to and mounted upon piers, such as concrete blocks, pilings or stabilizing jacks, at a site where the home will be occupied. It is important that the home also be anchored in position on the piers, with the use of soil anchors and ties extending from the anchors to the framework of the home, so as to avoid the home being shifted off of its piers by strong winds or earth tremors. If a home is inadvertently shifted off of its piers, this can cause serious damage to the home and also can cause human injury.

Various types of stabilizing devices have been used to stabilize the manufactured homes, to keep the homes from moving in response to wind forces and earth movement, such as guy wires, straps or other ties which connect the home to anchors or ground fixtures. A traditional approach to providing wind protection for manufactured homes consists of an anchor having a shaft with one or more helical plates at the bottom of the shaft which can be rotated to move into the earth, and cold-rolled steel strapping installed as diagonal ties between the upper exposed portion of the anchor and the lower main frame of the manufactured home. A system of this type is taught in U.S. Pat. No. 3,747,288. In addition, vertical or "over-the-top" ties may be installed in case of single-wide structures.

The vertical support for manufactured homes usually is provided by piers, such as concrete masonry piers or prefabricated steel piers or precast concrete jack stands located under the parallel joists of the main frame of the manufactured home, with the vertical supports being spaced longitudinally along the parallel joists at approximately 8' from one another. The soil anchors usually are installed vertically or even with a slight back angle just inside the perimeter of the home.

The portion of the anchor shaft of a typical soil anchor which is beneath and adjacent the surface of the soil has a relatively small surface area that contacts the soil. When the upper end of the anchor shaft is pulled laterally by a manufactured home being pushed by the wind, the upper portion of the anchor shaft usually is met with only small soil resistance, and the upper portion of the shaft tends to move through the soil and bend toward the manufactured home, allowing the home to move. Once the anchor has become bent toward the home, its resistance to horizontal movement increases.

One way of increasing resistance to the movement of the upper shaft portions of soil anchors without bending the anchors has been to drive a large stabilizer plate into the soil adjacent the anchor and between the anchor and its home, which spreads the pulling force applied by the tie to the anchor over a larger area in the soil.

Another way of increasing the resistance of the upper shaft portions of the soil anchors is to preload the anchor, by deliberately bending the upper ends of anchor shafts toward the home when the anchors are first installed so that the bending of the shaft will have been accomplished prior to the lateral forces being applied by the wind to the house.

Test data for this type of installation have been developed, and the performance of traditional anchor systems have been reviewed. It was shown that the load capacity and stiffness of helix-plate soil anchors generally are far less than what is required to provide adequate resistance against the loads resulting from wind storms and acting on the diagonal ties and the piers.

Based on extensive laboratory and field studies, the expectations for the performance of traditional anchoring systems are higher than the actual levels of resistance that the anchoring systems can reasonably be expected to provide.

The large horizontal displacements required to bend the anchors and therefore develop acceptable levels of anchor resistance are incompatible with the much shorter horizontal displacement limits of the home which are needed to insure pier stability to support the home.

Stabilizer plates and similar devices which are installed adjacent the head of a soil anchor exhibit low resistance and high variability to anchor head movement which makes them minimally effective for increasing the lateral resistance of soil anchors.

The U.S. Department of Commerce, Department of Housing and Urban Development released a report, NISTIR 5664 entitled "Recommended Performance-Based Criteria for the Design of Manufactured Home Foundation Systems to Resist Wind and Seismic Loads," (August 1995). This report recommends that preloaded soil anchors be used. By preloading it is meant that the anchor is bent prior to use in the direction of the manufactured home until it resists a certain amount of force, typically 3,000 lbs. The tie extending between the anchor head and the lower frame of the home is then tightened. In particular, the pre-loading can produce a significant increase in anchor stiffness, thus eliminating the need for stabilizer plates and similar devices which have been shown to be somewhat ineffective. The limited test data that are available for cold-rolled steel strapping suggests an in-service ultimate capacity of about 16.9 kN (3,800 lbf). The factored diagonal tie load for a basic wind speed of 44.7 m/s (100 mph) is 7.55 kN/m (518 lbf/ft), resulting in a maximum anchor spacing of 2.24 m (7.3 ft). However, at higher wind speeds the anchor spacing becomes so small that the cones of influence of the helix plate in the soil begin to overlap. Therefore, even with preloading, the traditional shallow anchor/tie/pier system is limited in application to basic wind speeds less than about 44.7 m/s (100 mph).

What is needed, but apparently is not available, is a foundation stabilizing system for manufactured homes that provides improved resistance to horizontal movement as well as resistance to vertical displacement of the traditional soil anchor.

SUMMARY OF THE INVENTION

Briefly described, the present invention comprises a foundation for a manufactured home of the type that is mounted on piers, wherein the piers are supported by the ground and usually are arranged in pairs with the piers of each pair being aligned across the length of the home. The I-beam joists of the home are parallel to each other and extend along the length of the home and form part of the framework of the home. The I-beam joists rest on the pairs of piers positioned beneath the home, with the piers usually bearing the full weight of the home. In the situation where two home units are placed side by side to form a "double-wide" structure, there usually will be separate pairs of I-beams and piers for each home unit.

The stabilizing foundation system includes soil anchors inserted into the ground at the side edge of the home and aligned with the pairs of piers to form an anchor-piers-anchor alignage. Outer stabilizer bars are positioned on the ground and extend between and abut the anchors and their adjacent piers. Ties connect the anchors to the lower frame of the manufactured home. Therefore, the anchor which penetrates the soil, a tie extending between the head of the anchor to the frame of the home, a pier supporting the home, a stabilizer bar having its ends in abutment with the anchor and the pier, and the weight of the home bearing upon the pier, all act in combination to resist movement of the home. The lateral force of the wind blowing against the home is resisted by the anchor and the tie, and the forces on the anchor applied by the tie are partially transferred by the stabilizer bar to the pier and movement of the stabilizer bar is resisted by the pier.

In one embodiment of the invention, tie down shoes are positioned at the lower end of the piers and ties are connected to the tie down shoes and extend upwardly from the shoes over the I-beam joists of the framework of the home, and to an anchor or to another tie down shoe of the adjacent pier. The use of the tie down shoe and its ties assist in holding the home down in opposition to the lifting forces applied by the winds to the home, and resists lateral displacement of the piers from one another and from the associated anchors, and resists lateral displacement of the manufactured home.

If desired, an intermediate stabilizer bar can be placed between the piers of a pair of piers so as to further resist the piers moving toward one another in response to wind forces and to transfer some of the lateral forces applied by the wind to the leeward anchor.

One result of this structure is that the lateral wind forces applied to the manufactured home tend to increase the effective weight of the manufactured home on the piers beneath the home. The ties that extend from the anchors to the I-beam joists of the home and the ties that extend between the tie down shoes and the I-beam joists of the home are sloped upwardly from the anchors and tie down shoes so that when the lateral forces applied by the wind to the home tend to tighten the inclined ties, the angles of the ties cause the ties to pull the lower frame of the home downwardly against its piers. Further, the stabilizer bar which engages between each anchor and its adjacent pier keeps the anchor from moving toward the home structure, so that significant movement of the I-beam joist of the home structure is substantially avoided.

Thus, it is an object of this invention to provide an improved foundation for a manufactured home which stabilizes the home against wind forces and earth movements.

Another object of this invention is to provide a stabilized foundation system for manufactured homes which transfers at least a portion of the lateral wind force exerted upon the home from anchors on the windward side of the home to anchors on the leeward side of the home, thus providing the home with greater resistance to movement.

A further object of this invention is to provide a stabilizing foundation system for manufactured homes that includes tie down shoes positioned at the lower portions of the piers of the home and diagonal ties connected between the tie down shoes, the frame of the home, and either to other tie down shoes or soil anchors, thereby providing increased resistance to lateral shifting of the home in response to lateral wind forces and earth movements.

Another object of this invention is to provide an inexpensive stabilizing foundation system for manufactured homes, utilizing traditional soil anchors, wherein the pull-out forces applied to the anchors are maintained in an approximate vertical direction.

Another object of the invention is to provide a foundation system for manufactured homes that uses both soil anchors and piers which support the home as anchors to which ties are connected for resisting lateral movement and uplift of the home due to wind forces.

Another object of this invention is to provide a foundation system for manufactured homes which provides increased hold-down power to the home.

Other objects, features and advantages of the present invention will become apparent upon reading the following specification, when taken in conjunction with the accompanying drawings.

DETAILED DESCRIPTION

Figure 1:
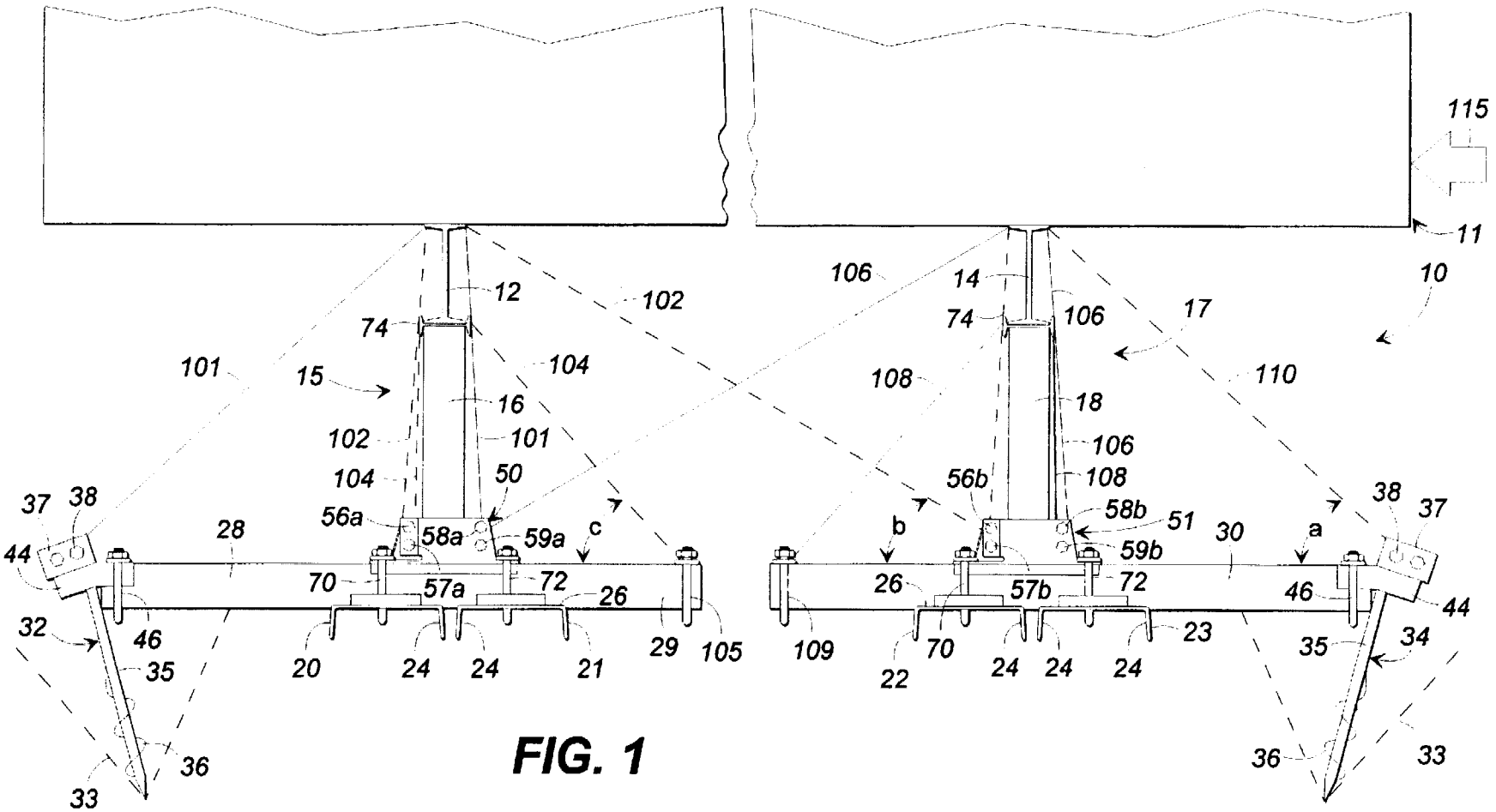
FIG. 1 is a side elevational view of the foundation for a manufactured home.

Referring now in more detail to the drawings, in which like numerals indicate like parts throughout the several views, FIG. 1 illustrates a foundation 10 for supporting a manufactured home 11. The manufactured home is constructed on a pair of parallel, horizontally extending I-beam joists 12 and 14 at a manufacturing site (not shown). After the construction of the manufactured home has been completed, the manufactured home is then transferred to a permanent site illustrated in FIG. 1 where it is to be mounted on piers 16 and 18, where the home will be occupied. The piers 16 and 18 have lateral sides, extend upright, and can be formed of steel, concrete, wood or other appropriate building material for the geographical site.

When the manufactured home is to be mounted on its foundation, the home typically is placed directly over its site of erection and the foundation is constructed beneath the home, and the home is lowered to rest on its foundation. Cleated support plates 20–23 are placed beneath the I-beam joists 12 and 14 and are aligned with each other across the length of the joists. Typically, there will be a pair of support plates for each pier. The support plates have cleats 24 which extend downwardly from a horizontal platform 26, and the cleats penetrate the ground. The platform 26 of each support plate provides a surface for supporting other elements of the foundation. The cleats inhibit any lateral shifting of the support plates. Stabilizer bars 28 and 30 are placed on the support plates 20–23, with stabilizer bar 28 placed on support plates 20 and 21 and stabilizer bar 30 placed on support plates 22 and 23. The stabilizer bars 28 and 30 extend at a right angle with respect to the lengths of the I-beam joists 12 and 14, and are approximately aligned with each other.

Figure 2:
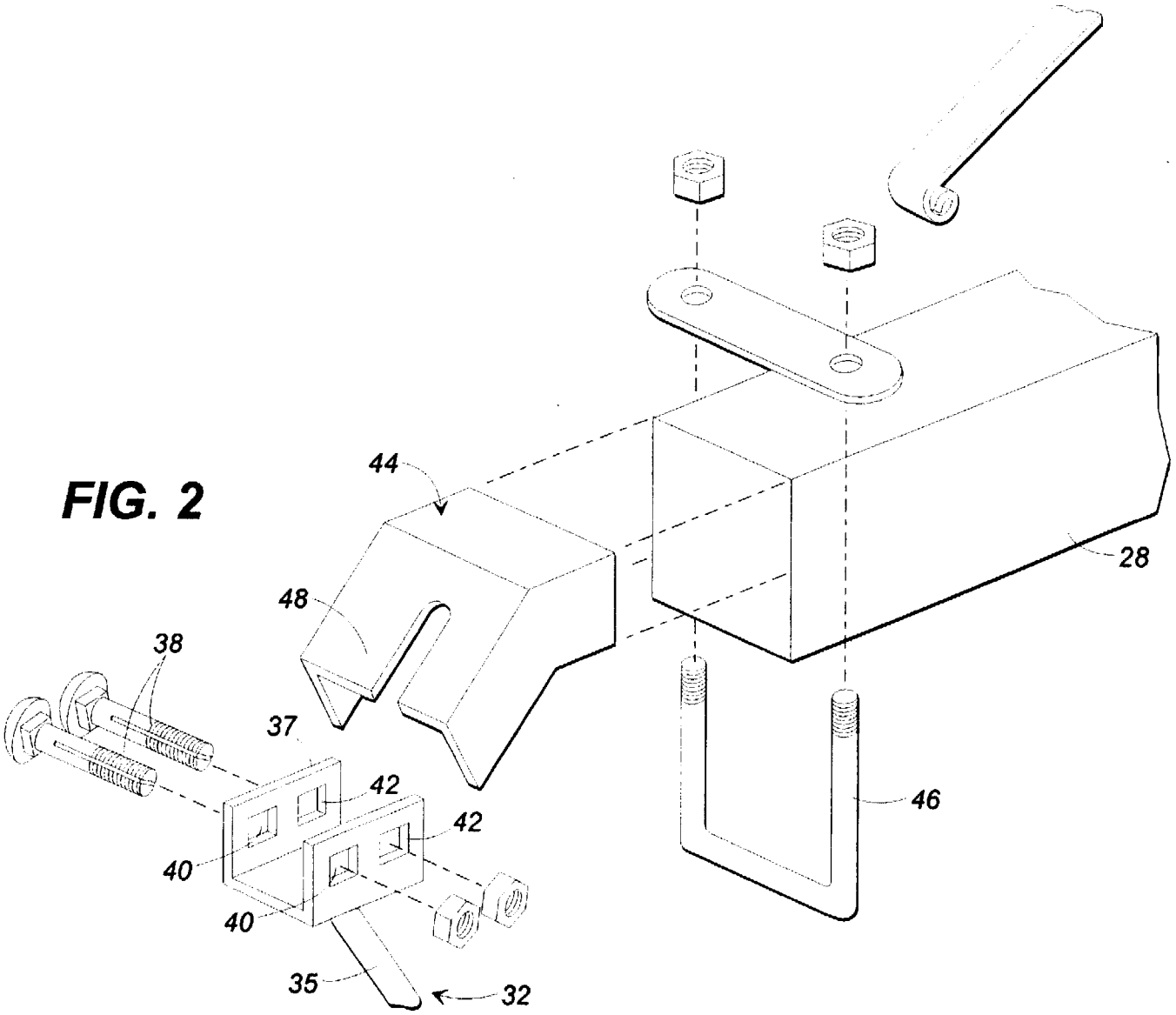
FIG. 2 is an expanded perspective view of the upper portion of a tie down anchor, its anchor bracket, the end of a stabilizer bar and the end of a tie.

Tie down anchors 32 and 34 are inserted in the ground at the outer ends of stabilizer bars 28 and 30 adjacent outer sides of the piers 16 and 18, with each tie down anchor including a shaft 35 which penetrates the ground, a helical blade 36 surrounding the lower end of the shaft 35, and a tensioning head 37 rigidly mounted to the upper end of the shaft 35 and positioned above the ground. The tensioning head is approximately U-shaped (FIG. 2), with slotted bolts 38 extending through aligned openings 40, 42 in the tensioning head, so that ties can be inserted at their ends into the slots of the bolts and the bolts rotated to wind the ties about the bolts for tightening the ties. An anchor bracket 44 is mounted at the outer end of each stabilizer bar 28 with a U-bolt 46 rigidly mounting the anchor bracket to the outer end of the stabilizer bar, and orienting the sloped bifurcated skirt 48 of the anchor bracket into engagement with the shaft 35 of the tie down anchor.

As illustrated in FIG. 1, the upright piers 16 and 18 are mounted on and are supported by the lateral stabilizer bars 28 and 30, respectively. The lower ends of the piers 16 and 18 are mounted to the stabilizer bars by tie down shoes 50 and 51, respectively.

Figure 5:
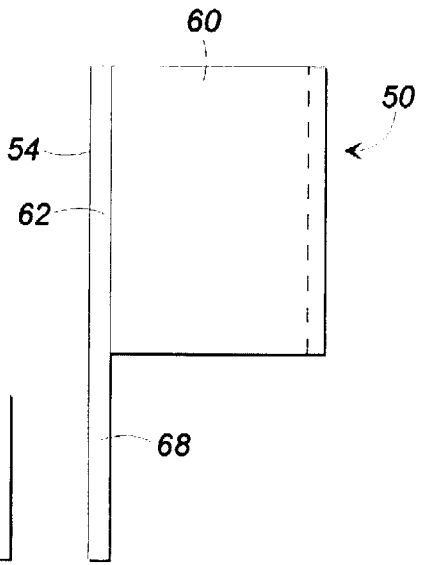
FIG. 5 is an end elevational view of a plate of the tie down shoe of FIG. 3.
Figure 3:
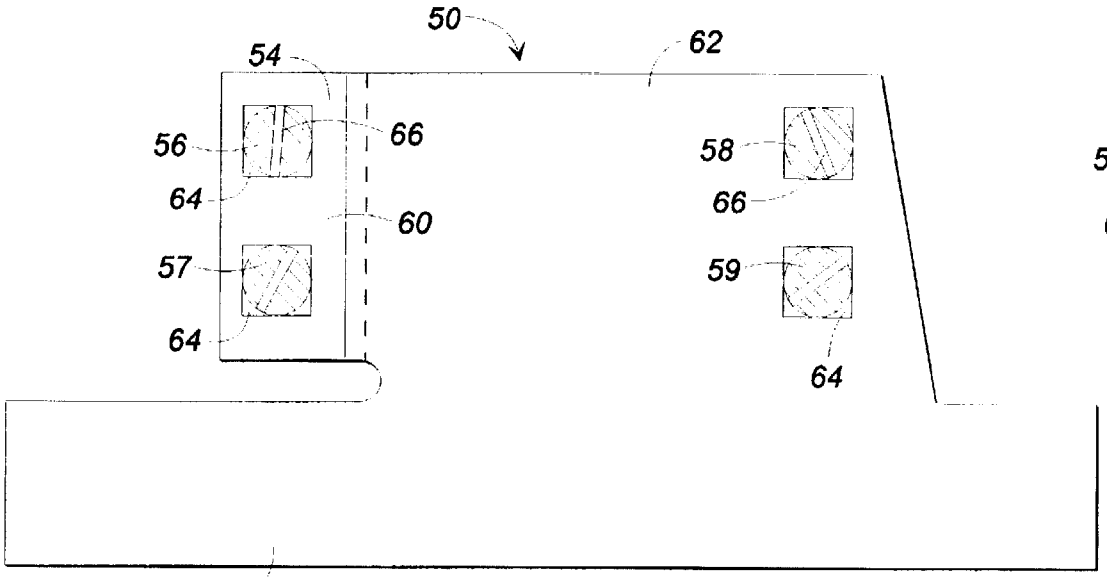
FIG. 3 is a side elevational view of a tie down shoe.
Figure 4:
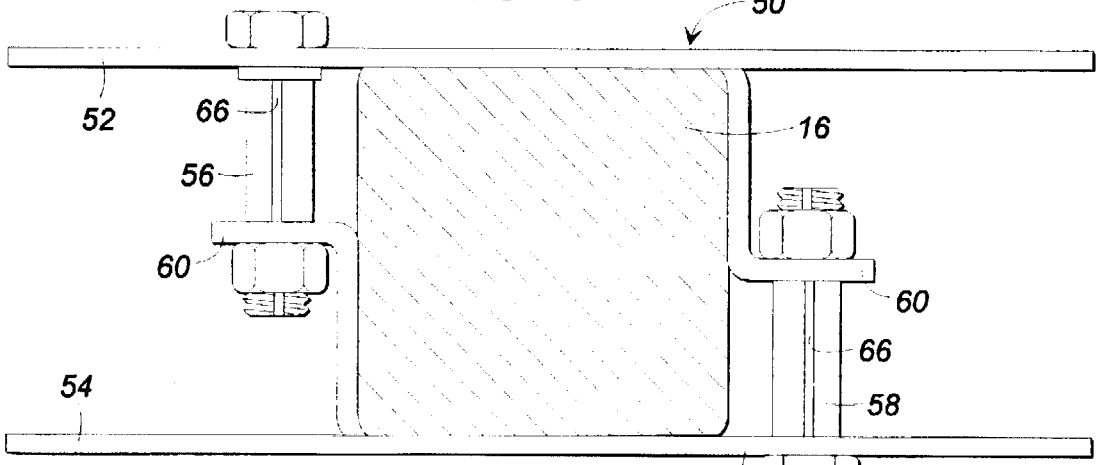
FIG. 4 is a top view of the tie down shoe.

As illustrated in FIGS. 3–5, tie down shoes 50 each comprise a pair of identical plates 52 and 54 which are assembled on opposite sides of the pier 16 and connected together by slotted bolts 56, 57, 58 and 59. The tie down plates 52 and 54 each include an L-shaped connector tab 60 which is offset from the upper body portion 62 of the plate and which defmes square bolt receiving openings 64 which are aligned with similar bolt receiving opening of the opposing plate. The portion of the shafts of the bolts adjacent the heads of the bolts are square and are sized so as to fit into the square openings 64, so as to become non-rotatable with respect to the tie down shoes when the bolts are drawn fully into position in the plates by the nuts of the bolts. The slots 66 of the bolts receive the ties of the foundation, and the ties can be spirally wound around the bolts by rotating the bolts before the squared shanks of the bolts are drawn fully into the square openings 64.

The lower body portions 68 of the plates 52 and 54 of the tie down shoes 50 extend beneath and laterally beyond the upper body portions 62. U-bolts 70 and 72 (FIG. 1) connect the ground support plates 20–24 to the protruding ends of the lower body portion 68 of the tie down shoes 50. With this arrangement, the tie down shoes are firmly connected to the stabilizer bars 28 and 30 and to the piers 16 and 18 and to the cleated ground support plates 20–23, thereby firmly connecting the piers 16 and 18 to the stabilizer bars 28 and 30 and to the ground.

Figure 6:
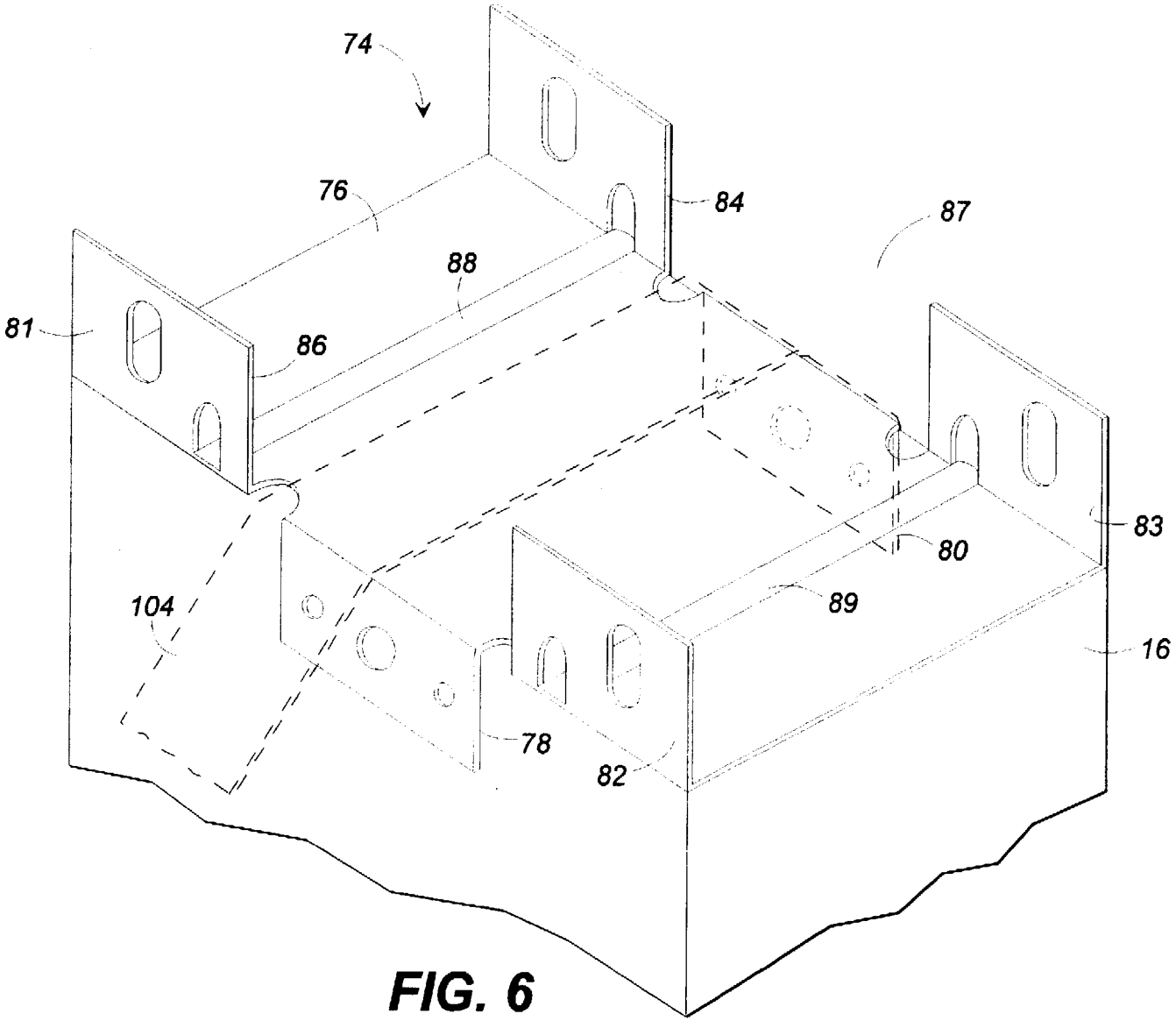
FIG. 6 is a perspective illustration of the pier plate that is mounted between the upper end of a pier and the I-beam joist supported by the pier, showing how the ties pass over the plate, between the upper end of the pier and the joist.

As illustrated in FIG. 1, pier plates 74 are placed on the upper ends of piers 16 and 18, beneath the I-beam joists 12 and 14 of the manufactured home. As illustrated in FIG. 6, the pier plates 74 each include a platform which is placed on top of the pier and beneath the joist, downwardly turned locating tabs 78 and 80 which extend from the intermediate portions of opposite sides of the platform 76, and upwardly turned locating tabs 81, 82, 83 and 84 which are positioned at the ends of the sides of the platform 76, straddling the downwardly turned tabs 78 and 80. This forms slots 86 and 87 above each of the downwardly turned tabs 78 and 80, between the upwardly turned tabs 81–84. Upwardly extending parallel ribs 88 and 89 extend across platform 76 between the upwardly turned locating tabs 81 and 84 and 82 and 83 respectively.

When the I-beam joist 12 or 14 is placed on the pier plate 74, the ribs 88 and 89 maintain a small space between the lower surface of the I-beam joist 12 or 14 and the pier plate, and ties 104, 108 of FIG. 1 are passed beneath the I-beam joist and over the pier plate.

As illustrated in FIG. 1, a plurality of ties are connected at their ends to the tie down anchors 32 and 34, and to the tie down shoes 50 and 51. In order to distinguish the ties from one another, some of the ties are shown in dash lines.

As illustrated in FIG. 1, anchor tie 101 is connected at one end to tie down anchor 32 and slopes upwardly from the tie down anchor at approximately 45°, and passes over the I-beam joist 12, and then extends downwardly to the tie down shoe 50, where it is connected to the upper bolt **58*a*. The anchor tie 101 is tightened by rotating the slotted bolt 38 (FIG. 2**) and locking the bolt in the square-shaped opening of the tensioning head of the anchor.

Shoe tie 102, illustrated in dash lines, is connected at one end to slotted bolt **57*a* of tie down shoe 50 and extends upwardly over I-beam joist 12, and then slopes downwardly to tie down shoe 51 where it is connected at its other end to slotted bolt 57*b* of the tie down shoe 51**.

Another shoe tie 104 is connected at one end to slotted bolt **56*a*, extends upwardly over pier 16 and its pier plate 74 and then slopes downwardly for connection at its other end to the extension 29 of the stabilizer bar 28, and is connected there by U-bolt 105**.

Shoe tie 106 is connected to slotted bolt **59*a* and is sloped upwardly from tie down shoe 50, extending over I-beam joist 14, and then downwardly from joist 14 and is connected at its lower end to slotted bolt 58*b***.

Shoe tie 108 is connected at one end to U-bolt 109 on extension 31 of stabilizer bar 30, slopes upwardly from U-bolt 109 and passes over pier 18 and its pier plate 74, then extends downwardly for connection to slotted bolt **59*b***.

Anchor tie 110 is connected at one end to tie down anchor 34, and slopes upwardly from the tie down anchor, over I-beam joist 14, and then extends downwardly for connection to slotted bolt **56*b* of tie down shoe 51**.

All of the ties 101, 102, 104, 106, 108, and 110 are tightened by rotating their slotted bolts, in a conventional manner.

As shown in FIG. 4, the slotted bolts on opposite sides of the tie down shoes 50 and 51 are offset from each other. This permits the ties to pass each other without intersecting each other. Moreover, as shown in FIG. 6, the slots 86 and 87 of the pier plates are wide enough so as to accommodate ties from either side of the tie down shoes.

When the foundation is assembled and the home is mounted on the foundation as illustrated in FIG. 1, and a force, such as wind force 115 is applied to the manufactured home 11, the following functions will be performed by the foundation. The home 11 tends to shift in the direction of the wind 115, which is from right to left in FIG. 1. The I-beam joists 12 and 14 tend to move with the home. Tie 110 that extends between anchor 34, over I-beam joist 14, and downwardly to the tie down shoe 51 tends to stretch and pull tie down anchor 34 in the direction of the tie, sloped upwardly from the anchor. The left movement of the tie down anchor 34 is resisted by the inherent strength of the anchor being partially buried in the earth, and also resisted by the stabilizer bar 30. Since the dead weight of the home 11 rests on pier 18, and since pier 18 is mounted on the stabilizer bar 30, and since the stabilizer bar 30 is locked by the U-bolts 70 and 72 to the cleated ground support plates 22 and 23, there will be no lateral yielding of the stabilizer bar in response to the forces applied to it by the tie down anchor 34, and therefore the abutment of the anchor against the outer end of the stabilizer bar 30 avoids lateral movement of the tie down anchor 34. Therefore, the lateral movement of the I-beam joist 14 is resisted.

The present invention also provides increased resistance to vertical displacement of the tie down anchors 32 and 34 and therefore avoids lifting of the manufactured home. The stabilizer bars 28 and 30 abut the anchors so as to prevent the anchors from bending toward the piers in response to wind forces applied against the side of the manufactured home. Therefore, the pull-out force on the soil anchors must be applied in an approximate vertical direction, parallel to the shafts of the anchors, the stabilizer bars position the tie down anchors in an effective preloaded geometry. Therefore, the entire cone of influence 33 of each anchor in the soil is utilized in preventing vertical pull-out of the anchor. The present invention allows preloading of the anchors without bending the anchor shafts, which simplifies the installation of the foundation, and which provides a predictable limitation on the potential lateral movement of the tie down anchors in response to wind forces applied to the manufactured home.

Moreover, the invention uses "dynamic forces" of the manufactured home to increase the horizontal support of the home as the wind load increases on the windward side of the home. For example, the sloped anchor ties 101 and 110 resist horizontal movement and vertical movement of the home. As the horizontal wind load increases, downward vertical force applied to the I-beam joists by the sloped tie is increased because of the slope of the ties extending downwardly from the joists back in the direction of the wind. For example, assuming that the angle A between the anchor tie 110 and the horizontal is 45°, a 1000 lb. horizontal force on the anchor tie 110 will generate approximately 700 lb. of downward vertical force on the I-beam joist 14 so as to offset the lifting force applied by the wind. This downward vertical force will increase as the angle of the anchor tie 110 increases. For example, if the anchor tie 110 is connected at 60° from the horizontal, a 1000 lb. horizontal wind load will result in 866 lb. of downward vertical force. This is calculated as: cos 60°×1000 lb=866 lb.

Likewise, if the angle B between the shoe tie 102 and the horizontal is 45°, a 1000 lb. horizontal wind load on the shoe tie 102 will result in over 700 lb. of downward vertical force on I-beam joist 12. Of course, in both instances, the dead weight of the home 11 would be added to the downward force.

In the instance where the home 11 tends to slightly shift laterally in response to the wind force 115, pier 16 would be further stabilized by shoe tie 104. For example, if the angle C between the shoe tie 104 and the horizontal is 60°, a 1000 lb. additional tension in shoe tie 104 would result in an additional downward force in the amount of 500 lb. This is calculated as: sin 60°×1000 lb=500 lb.

Stabilizer bars 28 and 30 are anticipated to be of rugged stock, such as 4×4 wooden beams which are suitable for withstanding compression forces applied by the tie down anchors 32 and 34 and by the piers 16 and 18. Therefore, the stabilizer bars function as lateral compression members in resisting the movement of the tie down anchors. Of course, other compression members might be used, such as metal beams, pipes, concrete slabs, and other items suitable to withstand the compressive forces applied by the tie down anchors and the piers and other elements of the foundation.

Figure 7:
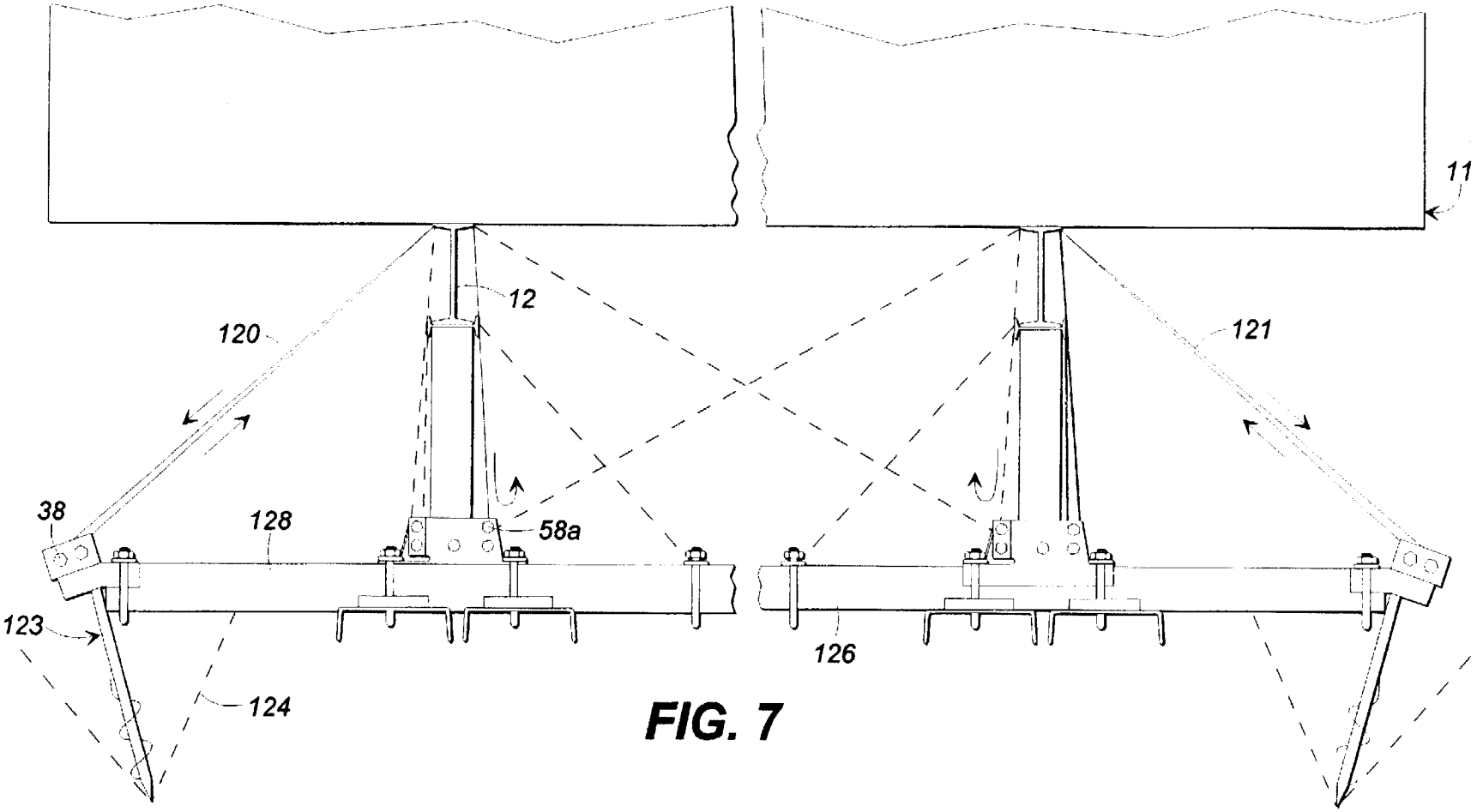
FIG. 7 is a side elevational view, similar to FIG. 1, but showing a double tie connection between the anchors and the tie down shoe.

FIG. 7 demonstrates the use of double anchor ties 120 and 121 in the foundation system. The anchor tie 120 is looped about slotted bolt 58*a*, and it is passed in double lengths over the top of I-beam joist 12, and its ends are fastened in the slots of the slotted bolts 38 of the tie down anchor 123. The doubling of the tie at the anchor 123 allows the tie to withstand substantially twice the load of a single tie. The use of the stabilizer bar 128 to buttress the tie down anchor 123 causes the anchor to increase its resistance to movement without increasing the structure of the anchor. Further, the near vertical attitude of the anchor 123 maximizes the amount of vertical resistance applied through its cone of influence 124.

Another feature of FIG. 7 is that the stabilizer bar 126 can extend completely from one side to the other side of the manufactured home, so that a single stabilizer bar is utilized. Thus, if more lateral forces are applied to one I-beam joist than to the other, the single stabilizer bar will receive substantially all of the lateral shifting forces, so that, for example, the forces applied by the windward anchor to the stabilizer bar will be transmitted directly through the stabilizer bar to the leeward anchor, thereby causing the leeward anchor to resist some of the lateral forces.

Figure 8:
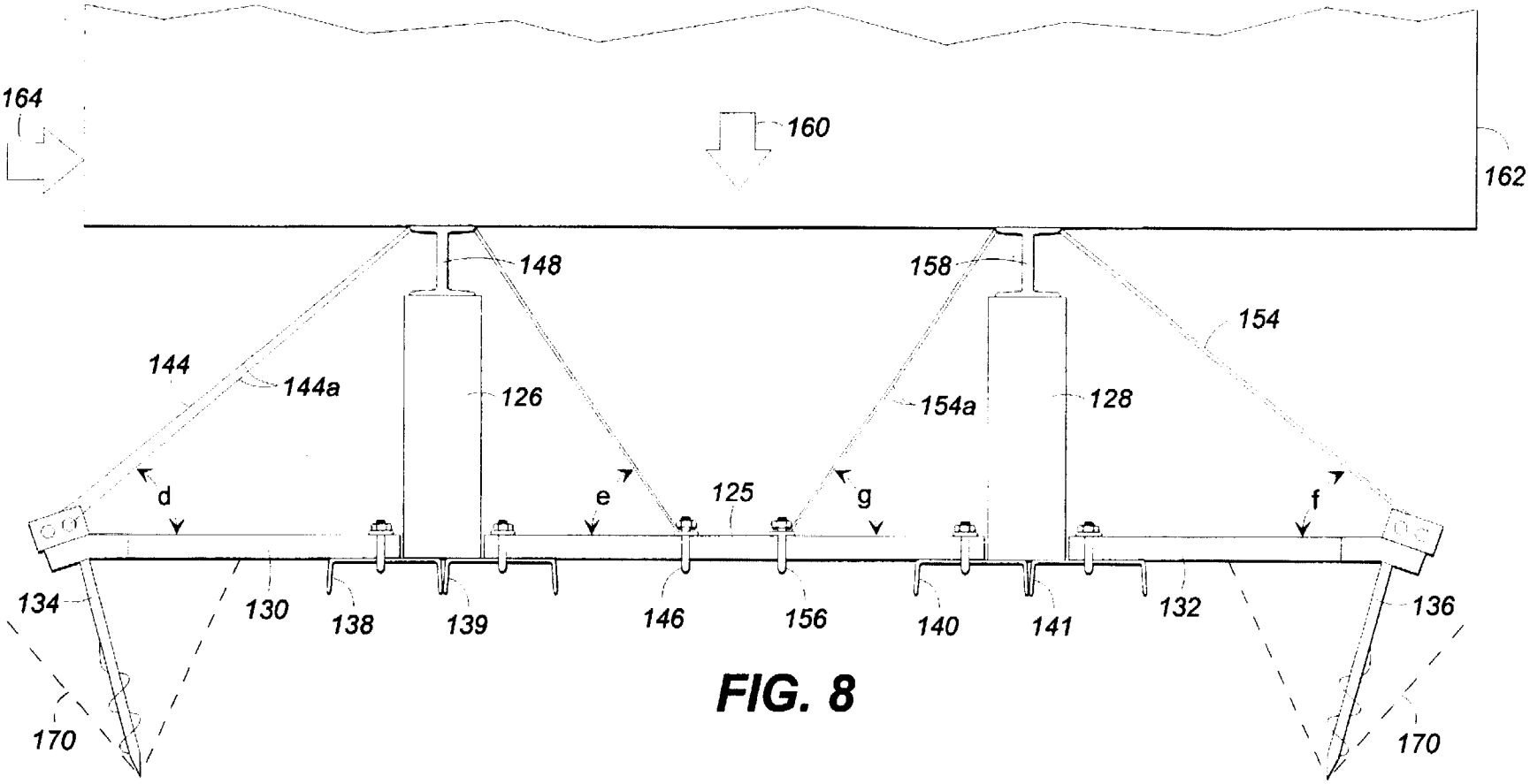
FIG. 8 is a side elevational view of another embodiment of the invention.

FIG. 8 of the drawings illustrates another embodiment of the invention, wherein an intermediate stabilizer bar 125 is positioned in end abutment with piers 126 and 128. Outer stabilizer bars 130 and 132 are in end abutment with piers 126 and 128, and tie down anchors 134 and 136. The ends of the stabilizer bars 125, 130 and 132 which are adjacent piers 126 are connected by U-bolts to the cleated ground support plate 138, 139, 140 and 141. A double anchor tie 144 is connected to intermediate stabilizer bar 125, about a U-bolt clamp 146, and extends up at a sloped angle of approximately 45° upwardly over I-beam joist 148, and then extends at a sloped angle downwardly so that its ends are connected to tie down anchor 134. Preferably, the angles D and E which are formed between the sloped runs of the tie 144 with respect to the horizontal are 45°.

Likewise, the double tie 154 extends from its U-bolt 156 which is rigidly mounted to the intermediate stabilizer bar 125, sloped upwardly over the I-beam joist 158, then slopes downwardly and is connected at its ends to the tie down anchor 136. Again, the preferred angles F and G formed between the sloped runs of the tie 154 and the horizontal are 45°.

In an example of how the foundation of FIG. 8 functions, it will be assumed that a dead vertical load in the amount of 3000 lbs. is applied by the manufactured home 162 to the pair of piers 126 and 128, as indicated by arrow 160. If a wind force in the amount of 6000 lbs. is applied laterally to the home 162 as indicated by arrow 164, the horizontal movement of the home 162 will be restrained by the sloped anchor ties 144 and 154. If angles D and G are the same, the lateral load applied to each of the anchor ties 144 and 154 will be one-half of the 6000 lb. lateral wind force, which is 3000 lbs. for each anchor tie. If angles D and G are both 45°, the force that must be resisted by the ties 144 and 154 will be 4243 lbs. for the double straps, or one-half that for each run of the double straps. This is calculated as: cos 45°=3000 lbs/Y. This same calculation applies to anchor tie 154, assuming its angle G is also 45°.

In addition, the wind load of 3000 lbs. for each pier 126 and 128 will result in an additional downward force being asserted by the anchor ties 144 and 154 through the pier 126 in the amount of 2121 lbs. (SIN 45°=x/4243 lbs). This assists the dead load 160 in retaining the manufactured home 162 on the ground during a wind storm.

As with the previous embodiments of the invention, the stabilizer bars 125, 130 and 132 maintain the tie down anchors 134 and 136 in their originally installed positions, with little likelihood that the anchors will bend toward I-beam joists 148 and 158 under the influence of the pulling forces of anchor ties 144 and 154. Likewise, the U-bolts 146 and 156, being rigidly mounted to intermediate stabilizer bar 125, are immovable along the length of the stabilizer bar, so that the tension applied to the ties 144 and 154 by the rotation of the slotted bolts in the tie down anchors 134 and 136 will not be lost in response to any movement of the manufactured home 162 in response to the wind force 164. The cones of influence 170 will be effective to retain the anchors 134 and 136 in the ground, in spite of the lateral forces being applied to the upper ends of the anchors.

While preferred embodiments of the invention have been disclosed in detail in the foregoing description and drawings, it will be understood by those skilled in the art that variations and modifications thereof can be made without departing from the spirit and scope of the invention as set forth in the following claims.

I claim:

1. A support assembly for supporting a manufactured home including parallel first and second support joists above a ground surface, said support assembly including:

a first upright pier and a second upright pier adapted to be aligned with each other across a length of the support joists of the manufactured home with each pier having an upper end, said upper end of each of said first upright pier and said second upright pier for supporting the first joist and the second joist respectively, said first upright pier and said second upright pier each having a lower end for placement adjacent the ground surface;

a first tie down shoe and a second tie down shoe positioned at the lower end of said first upright pier and said second upright pier respectively;

tie down anchors adapted to be anchored in the ground, a first tie down anchor positioned adjacent an outer side of said first upright pier, a second tie down anchor positioned adjacent an outer side of said second upright pier; and a first anchor tie and a second anchor tie, said first anchor tie and said second anchor tie connected to said first anchor and said second anchor respectively and said first anchor tie and said second anchor tie adapted to extend at an upward incline from said first anchor and said second anchor and over the first support joist and the second support joist respectively and downwardly from the support joists to connect to said first tie down shoe and said second tie down shoe respectively.

2. The support assembly of claim 1 and wherein each said tie down shoe is mounted to the lower end of each pier respectively.

3. The support assembly of claim 1 and further including a first shoe tie connected at a first end to said first tie down shoe and adapted to extend upwardly from said first tie down shoe, over the first joist and then extend at a downward incline from the first joist to connect at a second end to said second tie down shoe.

4. The support assembly of claim 1 and further including a first rectilinear lateral compression member extending between said first tie down anchor and the lower end of said first upright pier, said first rectilinear lateral compression member arranged to transmit movement of said first tie down anchor to said first upright pier and a second rectilinear lateral compression member extending between said second tie down anchor and the lower end of said second upright pier, said second rectilinear lateral compression member arranged to transmit movement of said second tie down anchor to said second upright pier.

5. The support assembly of claim 1 and further including a first lateral compression member and a second lateral compression member, said first lateral compression member and said second lateral compression member extending from said first tie down anchor and said second tie down anchor respectively and further extending beneath said first upright pier and said second upright pier respectively, so that the weight of the manufactured home rests on said lateral compression members.

6. The support assembly of claim 5 and wherein said first lateral compression member and said second lateral compression member are fastened to said first upright pier and said second upright pier respectively with said first tie down shoe and said second tie down shoe.

7. The tie down assembly of claim 5 and wherein each lateral compression member includes an extension portion, said extension portion of said first lateral compression member extending from beneath said first upright pier toward said second upright pier and said extension portion of said second lateral compression member extending from beneath said second upright pier toward said first upright pier, the tie down assembly further including a first compression member tie and a second compression member tie, said first compression member tie connected at a first end to said first tie down shoe, extending upwardly over said first upright pier, and sloped downwardly from said first upright pier toward and connected at a second end to said extension portion of said first lateral compression member, said second compression member tie connected at a first end to said second tie down shoe, extending upwardly over said second upright pier, and sloped downwardly from said second upright pier toward and connected at a second end to said extension portion of said second lateral compression member.

8. A support assembly for supporting an elongated manufactured home, comprising:

upright piers adapted to be positioned beneath the home with the piers arranged in pairs oriented across a length of the home;

tie down anchors adapted to be anchored in the ground, a single pair of tie down anchors positioned in alignment with and straddling each pair of piers;

lateral compression members, a single lateral compression member extending between each of said anchors and an adjacent one of said piers respectively, each said lateral compression member arranged to transmit movement of the anchor to the pier;

tie down shoes, a single tie down shoe mounted at a lower end of each of said piers; and means for tying each of said tie down shoes to one of an adjacent: (a) anchor, (b) tie down shoe, or (c) lateral compression member.

9. The support assembly of claim 8 and wherein each tie down shoe comprises means for rotatably tightening said means for tying, and means for non-rotatably holding said means for rotatably tightening said means for tying.

10. A support assembly for supporting a manufactured home having parallel support joists above the ground, said support assembly including:

a rectilinear lateral compression member adapted to be placed horizontally on the ground at a right angle with respect to the parallel support joists of the home, said rectilinear lateral compression member having a first end and a second end;

an upright pier having a lower end supported on said compression member at a position intermediate said ends of said compression member and further having an upper end adapted to be placed in supporting relationship with respect to one of the support joists of the home;

a tie down anchor adapted to be inserted in the ground at said first end of said compression member;

a tie down shoe mounted to said compression member at a point of intersection between said compression member and said pier; and a tie connected to said tie down anchor and adapted to extend over said one of the support joists and connected to said compression member adjacent said second end.

11. A support assembly for supporting a manufactured home having parallel support joists above the ground, said support assembly including:

an upright pier adapted to be placed in supporting relationship with respect to one of the support joists, said pier having a first and a second lateral side;

a rectilinear lateral compression member adapted to be placed horizontally on the ground at a right angle with respect to the parallel support joists of the home and extending on both of said lateral sides of said pier;

a tie down anchor adapted to be inserted in the ground at a first end of said compression member;

a tie connected to said anchor and adapted to extend in a sloped direction upwardly from said anchor and over said one of the support joists and extending in sloped direction downwardly from said one of the support joists to said lateral compression member adjacent said second lateral side of said pier; and means for connecting said tie to said compression member.

12. The support assembly of claim 11 and wherein said pier is mounted on said compression means.

13. A support assembly for supporting a manufactured home having parallel support joists above a ground surface, said support assembly including:

a first upright pier and a second upright pier adapted to be aligned with each other across a length of the support joist of the manufactured home with each pier having an upper end for supporting one of the support joints and a lower end adapted to be placed adjacent the ground surface;

a tie down shoe positioned at the lower end of at least said first upright pier;

a tie connected at one of its ends to said tie down shoe and sloped upwardly to and engaging the said second upright pier;

a tie down anchor adapted to be anchored in the ground and positioned adjacent an outer side of said first upright pier;

an anchor tie connected to said tie down anchor at a first end and adapted to extend at an upward incline from said tie down anchor and over a support joist supported by said first upright pier and downwardly from the support joist to connect at a second end to said tie down shoe; and a rectilinear lateral compression member extending between said tie down anchor and said lower end of said first upright pier and arranged to transmit movement of said tie down anchor to said first upright pier.

14. The support assembly of claim 13 and wherein said tie down shoe is mounted to the lower end of said first pier.

* * * * *